US006499312B1

(12) United States Patent
Bergman, Jr. et al.

(10) Patent No.: US 6,499,312 B1
(45) Date of Patent: Dec. 31, 2002

(54) CRYOGENIC RECTIFICATION SYSTEM FOR PRODUCING HIGH PURITY NITROGEN

(75) Inventors: Thomas John Bergman, Jr., Clarence Center, NY (US); Shanda Gardner Fry, Wheatfield, NY (US); Jeremy Michael Cabral, Kenmore, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/000,470

(22) Filed: Dec. 4, 2001

(51) Int. Cl.[7] ..... F25J 3/00
(52) U.S. Cl. ..... 62/643; 62/652; 62/909
(58) Field of Search ..... 62/643, 652, 909

(56) References Cited

U.S. PATENT DOCUMENTS

| | | | | |
|---|---|---|---|---|
| 4,439,220 A | | 3/1984 | Olszewski et al. | 62/31 |
| 4,448,595 A | | 5/1984 | Cheung | 62/31 |
| 4,453,957 A | | 6/1984 | Pahade et al. | 62/25 |
| 4,543,115 A | | 9/1985 | Agrawal et al. | 62/25 |
| 4,717,410 A | | 1/1988 | Grenier | 62/29 |
| 5,098,457 A | | 3/1992 | Cheung et al. | 62/24 |
| 5,137,559 A | | 8/1992 | Agrawal | 62/24 |
| 5,402,647 A | | 4/1995 | Bonaquist et al. | 62/24 |
| 5,697,229 A | | 12/1997 | Agrawal et al. | 62/643 |
| 5,806,340 A | * | 9/1998 | Tomita | 62/644 |
| 5,836,175 A | * | 11/1998 | Bonaquist | 62/652 |
| 5,906,113 A | | 5/1999 | Lynch et al. | 62/646 |
| 6,082,136 A | * | 7/2000 | Yoshino | 62/652 |
| 6,196,023 B1 | | 3/2001 | Corduan et al. | 62/650 |
| 6,279,345 B1 | | 8/2001 | Arman et al. | 62/647 |
| 6,321,568 B1 | * | 11/2001 | Lehman | 62/643 |

* cited by examiner

*Primary Examiner*—William C. Doerrler
(74) *Attorney, Agent, or Firm*—Stanley Ktorides

(57) ABSTRACT

A system for producing high and ultra high purity nitrogen comprising a first column for the production of nitrogen and a second column having a top condenser wherein boil off from the second column top condenser is turboexpanded to generate refrigeration for the system.

10 Claims, 1 Drawing Sheet

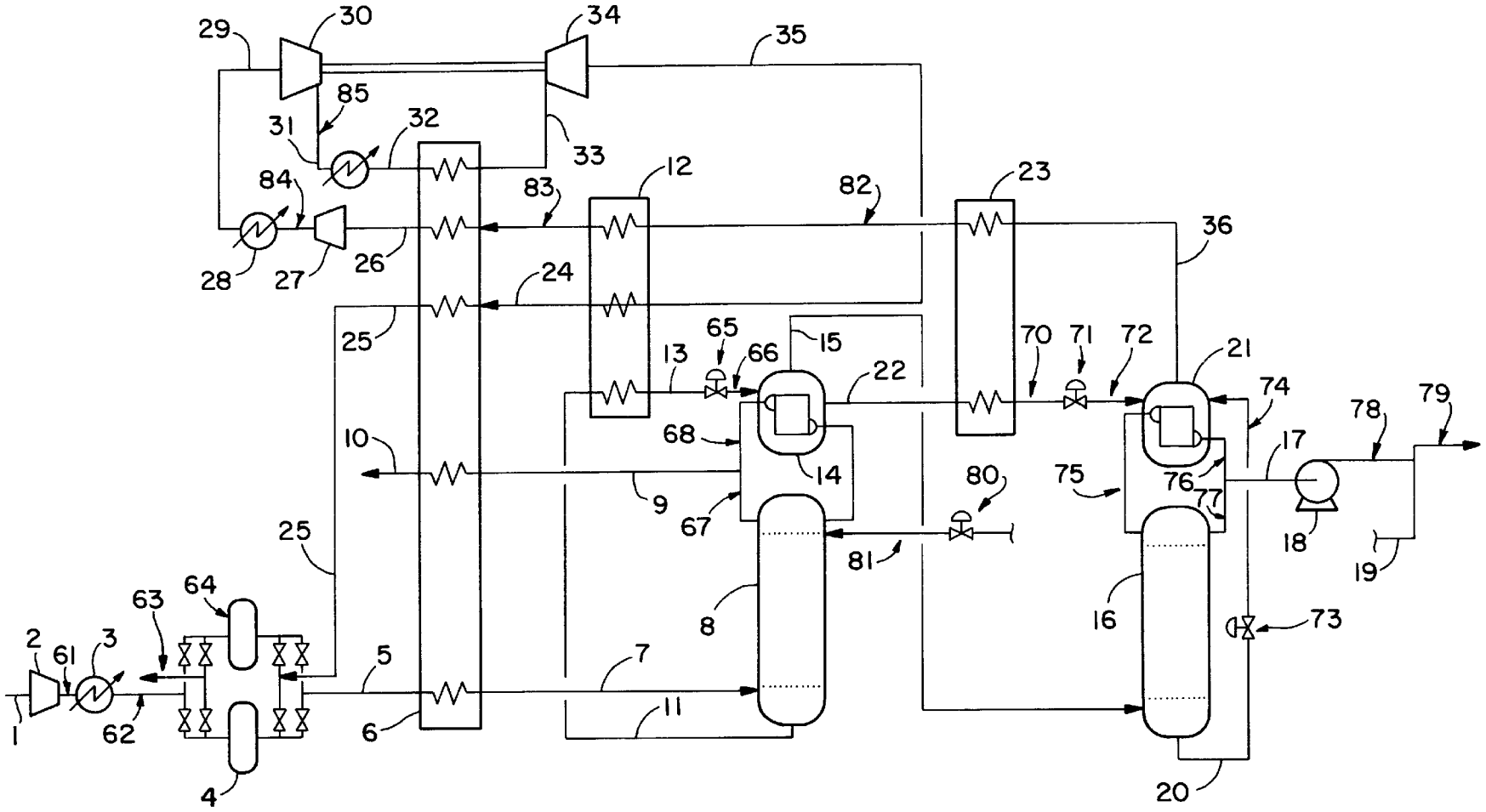
79
78
19
18
17
73
74
21
36
76
77
20
72
16
71
75
70
23
80
82
22
81
15
14
35
66
65
8
68
67
12
13
9
11
7
34
33
83
24
32
26
25
10
5
6
30
85
31
84
27
28
29
64
4
63
62
3
61
2
1

CRYOGENIC RECTIFICATION SYSTEM FOR PRODUCING HIGH PURITY NITROGEN

TECHNICAL FIELD

This invention relates generally to the cryogenic rectification of feed air and, more particularly, to the cryogenic rectification of feed air to produce high purity nitrogen and even ultra high purity nitrogen.

BACKGROUND ART

High and ultra high purity nitrogen is used extensively in the manufacture of high value components such as semiconductors where freedom from contamination by oxygen is critical to the manufacturing process. High purity nitrogen is generally produced in large quantities by the cryogenic rectification of feed air using a single column plant or a double column plant. The production of high purity nitrogen is energy intensive and any system which can produce high purity nitrogen with lower power requirements than heretofore available systems would be highly desirable.

Accordingly it is an object of this invention to provide a system for producing high and ultra high purity nitrogen by the cryogenic rectification of feed air which has lower power requirements than do heretofore available comparable conventional systems.

SUMMARY OF THE INVENTION

The above and other objects, which will become apparent to those skilled in the art upon a reading of this disclosure, are attained by the present invention, one aspect of which is:

A method for producing high purity nitrogen comprising:

(A) cooling feed air, passing cooled feed air into a first column, and producing by cryogenic rectification within the first column first high purity nitrogen fluid and first oxygen-enriched fluid;

(B) passing at least a portion of the first oxygen-enriched fluid into a second column and producing by cryogenic rectification within the second column second high purity nitrogen fluid and second oxygen-enriched fluid;

(C) warming second oxygen-enriched fluid to produce oxygen-enriched vapor, and turboexpanding the oxygen-enriched vapor to generate refrigeration;

(D) employing refrigeration from the oxygen-enriched vapor to cool the feed air; and (E) recovering a portion of the first high purity nitrogen fluid as product high purity nitrogen.

Another aspect of the invention is:

Apparatus for producing high purity nitrogen comprising:

(A) a main heat exchanger, a first column, and means for passing feed air to the main heat exchanger and from the main heat exchanger to the first column;

(B) a second column having a top condenser, and means for passing fluid from the lower portion of the first column into the second column;

(C) means for passing fluid from the lower portion of the second column into the second column top condenser;

(D) a turboexpander, means for passing fluid from the second column top condenser to the turboexpander, and means for passing fluid from the turboexpander to the main heat exchanger; and (E) means for recovering high purity nitrogen from the upper portion of the first column.

As used herein the term "feed air" means a mixture comprising primarily oxygen and nitrogen, such as ambient air.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "top condenser" means a heat exchange device that generates column downflow liquid from column vapor.

As used herein the terms "turboexpansion" and "turboexpander" mean respectively method and apparatus for the flow of high pressure gas through a turbine to reduce the pressure and the temperature of the gas thereby generating refrigeration.

As used herein the term "subcooling" means cooling a liquid to be at a temperature lower than the saturation temperature of that liquid for the existing pressure.

As used herein the terms "upper portion" and "lower portion" mean those sections of a column respectively above and below the mid point of the column.

As used herein the term "high purity nitrogen" means a fluid having a nitrogen concentration of at least 99 mole percent, preferably at least 99.9 mole percent, most preferably at least 99.999 mole percent. A particularly desirable form of high purity nitrogen is ultra high purity nitrogen which is a fluid having a nitrogen concentration of at least 99.999999 mole percent.

BRIEF DESCRIPTION OF THE DRAWING

The sole Figure is a simplified schematic representation of one preferred embodiment of the cryogenic rectification system of this invention.

DETAIL DESCRIPTION

The invention will be described in detail with reference to the Drawing. Referring now to the Figure, feed air 1 is compressed by passage through compressor 2 to a pressure generally within the range of from 100 to 200 pounds per square inch absolute (psia). Resulting compressed feed air 61 is cooled of heat of compression in cooler 3 and then passed as stream 62 to a purification system. In the embodiment of the invention illustrated in the Figure, the purification system comprises two or more beds of adsorbent material. The particular purification system illustrated in the Figure has two adsorbent beds numbered 4 and 64. The feed air passes through one of the beds, e.g. bed 4, and in the process high boiling impurities such as carbon dioxide, water vapor and hydrocarbons are adsorbed from the feed air onto the adsorbent material. While this is occurring the other bed is being cleaned or desorbed of adsorbed impurities by the passage therethrough of purge gas. This continues until the adsorbing bed is loaded with impurities and the desorbing bed is cleaned, whereupon the flows are reversed, using the system of valves illustrated in the Figure, so that the impurity containing feed air is passed to the other bed, i.e. bed 64, and the purge gas is provided to loaded bed 4. This procedure continues in a cyclic manner producing substantially continuous streams of impurity containing purge gas 63 for removal from the process, and clean feed air 5.

The clean feed air 5 is passed to main or primary heat exchanger 6 wherein it is cooled, preferably to about its dew point. The embodiment of the invention illustrated in the Figure is a preferred embodiment wherein the main heat exchanger is a single unit. It is understood however that the main heat exchanger could comprise two or more units. The resulting cooled feed air is passed from main heat exchanger 6 as stream 7 into first column 8.

First column 8 is operating at a pressure generally within the range of from 100 to 200 psia. Within first column 8 the feed air is separated by cryogenic rectification into first high purity nitrogen fluid and first oxygen-enriched fluid. First oxygen-enriched fluid is withdrawn from the lower portion of first column 8 in liquid stream 11 and subcooled by passage through subcooler 12. Resulting subcooled first oxygen-enriched liquid 13 is passed through valve 65 and as stream 66 into the boiling side of first column top condenser 14.

First high purity nitrogen fluid is withdrawn as vapor stream 67 from the upper portion of first column 8 and a first portion 9 of stream 67 is warmed by passage through primary heat exchanger 6 and recovered as product high purity nitrogen gas 10. A second portion 68 of first high purity nitrogen vapor 67 is passed into the condensing side of first column top condenser 14 wherein it is condensed by indirect heat exchange with the first oxygen-enriched fluid. The resulting condensed high purity nitrogen liquid is passed in stream 69 from first column top condenser 14 into the upper portion of first column 8 as reflux.

First oxygen-enriched liquid 66 is partially vaporized by the aforesaid indirect heat exchange with the first high purity nitrogen vapor in first column top condenser 14. The resulting first oxygen-enriched vapor is passed in stream 15 from first column top condenser 14 into the lower portion of second column 16. The remaining oxygen-enriched liquid is withdrawn from first column top condenser 14 in stream 22 and subcooled by passage through subcooler 23. Resulting subcooled stream 70 is passed through valve 71 and as stream 72 into the boiling side of second column top condenser 21.

Second column 16 is operating at a pressure generally within the range of from 40 to 120 psia. Within second column 16 the first oxygen-enriched fluid is separated by cryogenic rectification into second high purity nitrogen fluid and into second oxygen-enriched fluid. The second oxygen-enriched fluid is withdrawn from the lower portion of second column 16 as liquid stream 20, passed through valve 73 and as stream 74 into second column top condenser 21.

Second high purity nitrogen fluid is withdrawn as vapor stream 75 from the upper portion of second column 16 and passed into the condensing side of second column top condenser 21 wherein it is condensed by indirect heat exchange with the fluids which were passed into the boiling side of second column top condenser 21. The resulting boil-off vapor is withdrawn from second column top condenser 21 in oxygen-enriched vapor stream 36. Condensed second high purity nitrogen liquid is withdrawn from second column top condenser 21 in stream 76 and a first portion thereof is passed as stream 77 into the upper portion of second column 16 as reflux. A second portion 17 of high purity nitrogen liquid 76 is pumped through liquid pump 18 to form pumped high purity nitrogen liquid stream. If desired, a portion 79 of stream 78 may be recovered as high purity nitrogen liquid product. The remainder 19 of stream 78 is passed through valve 80 and as stream 81 into the upper portion of first column 8 as additional reflux.

Oxygen-enriched vapor 36 from second column top condenser 21, which typically has an oxygen concentration within the range of from 35 to 50 mole percent, is turboexpanded to generate refrigeration and this refrigeration is used to drive the rectification. This generation and use of the refrigeration enables a reduction in the power requirements of the system. The embodiment of the invention illustrated in the Figure is a preferred embodiment wherein the oxygen-enriched vapor from top condenser 21 is compressed prior to the turboexpansion.

Referring back now to the Figure, oxygen-enriched vapor 36 is warmed in subcooler 23 by indirect heat exchange with subcooling oxygen-enriched liquid 22 and resulting oxygen-enriched vapor 82 is warmed in subcooler 12 by indirect heat exchange with subcooling oxygen-enriched liquid 11. Resulting oxygen-enriched vapor 83 is passed to main heat exchanger 6 wherein it is further warmed to form oxygen-enriched vapor stream 26. Stream 26 is compressed by passage through compressor 27 and resulting compressed stream 84 is cooled of the heat of compression in cooler 28 to form stream 29. Oxygen-enriched vapor stream 29 is compressed, generally to a pressure within the range of from 25 to 75 psia by passage through compressor 30 and compressed oxygen-enriched vapor stream 85 from compressor 30 is cooled of the heat of compression in cooler 31 to form stream 32. Oxygen-enriched vapor stream 32 is further cooled by passage through main heat exchanger 6 and resulting cooled compressed oxygen-enriched vapor stream 33 is passed to turboexpander 34 wherein it is turboexpanded to generate refrigeration.

The embodiment of the invention illustrated in the Figure is a particularly preferred embodiment wherein turboexpander 34 is mechanically coupled to compressor 30 thereby serving to drive compressor 30. Refrigeration bearing oxygen-enriched vapor stream 35 from turboexpander 34 is warmed by passage through subcooler 12 thereby providing cooling for the subcooling of first oxygen-enriched liquid 11, and resulting oxygen-enriched vapor stream 24 is passed to main heat exchanger 6. Within main heat exchanger 6 the refrigeration bearing oxygen-enriched vapor is warmed thereby providing some of the cooling to cool cleaned compressed feed air 5. The resulting warmed oxygen-enriched vapor 25 from main heat exchanger 6 is removed from the system. The embodiment of the invention illustrated in the Figure is a preferred embodiment wherein oxygen-enriched vapor from the main heat exchanger is used as the purge gas to clean the loaded adsorbents. As shown in the Figure, warmed oxygen-enriched vapor 25 is passed, using the arrangement of valves, alternatively through beds 4 and 64, and then out of the system as loaded purge gas 63.

To illustrate the advantages of the invention over known systems, there is presented in Table 1 a comparison of the power requirements of the invention carried out in accordance with the embodiment illustrated in the Figure, reported in column A, with the power requirements of a comparable known process reported in column B. The known process is that disclosed in U.S. Pat. No. 5,098,457. As can be seen from the data reported in Table 1, the invention enables in this example a better than 6 percent power advantage over the known system.

TABLE 1

| | A | B |
|---|---|---|
| Air Flow (cfh-NTP) | 693,500 | 740,500 |
| Air Pressure (psia) | 185.2 | 185.2 |
| Gaseous Nitrogen Flow (cfh-NTP) | 350,000 | 350,000 |
| Liquid Nitrogen Flow (cfh-NTP) | 14,000 | 14,000 |
| Nitrogen Purity (ppb $O_2$) | 0.27 | 0.27 |
| Nitrogen Pressure (psia) | 174.7 | 174.7 |
| Power (hp) | 3272 | 3502 |

Although the invention has been described in detail with reference to a certain particularly preferred embodiment, those skilled in the art will recognize that there are other embodiments of the invention within the spirit and the scope of the claims.

What is claimed is:

1. A method for producing high purity nitrogen comprising:

(A) cleaning feed air in a purification system, cooling cleaned feed air, passing cooled feed air into a first column having a top condenser, and producing by cryogenic rectification within the first column first high purity nitrogen fluid and first oxygen-enriched fluid;

(B) passing first oxygen-enriched fluid into the first column top condenser, passing a portion of the first oxygen-enriched fluid from the first column top condenser into a second column having a top condenser, passing a portion of the first oxygen-enriched fluid from the first column top condenser to the second column top condenser, and producing by cryogenic rectification within the second column second high purity nitrogen fluid and second oxygen-enriched fluid;

(C) warming second oxygen-enriched fluid to produce oxygen-enriched vapor, and turboexpanding the oxygen-enriched vapor to generate refrigeration;

(D) employing refrigeration from the oxygen-enriched vapor to cool the feed air and using the oxygen-enriched vapor to clean the purification system; and (E) recovering a portion of the first high purity nitrogen fluid as product high purity nitrogen.

2. The method of claim 1 wherein the second oxygen-enriched fluid is warmed by indirect heat exchange with second high purity nitrogen fluid.

3. The method of claim 1 wherein the oxygen-enriched vapor is compressed prior to being turboexpanded.

4. The method of claim 1 further comprising recovering second high purity nitrogen fluid as product high purity nitrogen.

5. The method of claim 1 further comprising passing second high purity nitrogen fluid into the upper portion of the first column.

6. Apparatus for producing high purity nitrogen comprising:

(A) a purification system, a main heat exchanger, a first column having a top condenser, and means for passing feed air to the purification system, from the purification system to the main heat exchanger and from the main heat exchanger to the first column;

(B) a second column having a top condenser, means for passing fluid from the lower portion of the first column to the first column top condenser, means for passing fluid from the first column top condenser into the second column, and means for passing fluid from the first column top condenser to the second column top condenser;

(C) means for passing fluid from the lower portion of the second column into the second column top condenser;

(D) a turboexpander, means for passing fluid from the second column top condenser to the turboexpander, and means for passing fluid from the turboexpander to the main heat exchanger and from the main heat exchanger to the purification system; and (E) means for recovering high purity nitrogen from the upper portion of the first column.

7. The apparatus of claim 6 further comprising a compressor, wherein the means for passing fluid from the second column top condenser to the turboexpander includes the compressor.

8. The apparatus of claim 6 further comprising means for recovering high purity nitrogen from the upper portion of the second column.

9. The method of claim 1 wherein the purification system comprises two or more beds of adsorbent material.

10. The apparatus of claim 6 wherein the purification system comprises two or more beds of adsorbent material.

* * * * *